United States Patent [19]

Yong

[11] Patent Number: 4,736,735

[45] Date of Patent: Apr. 12, 1988

[54] BACK MASSAGER WITH TWO SUPPORT BARS FOR BACK

[76] Inventor: Kim C. Yong, 1245 Saint Andrews Ct., Ontario, Calif. 91761

[21] Appl. No.: 17,572

[22] Filed: Feb. 24, 1987

[51] Int. Cl.[4] ..... A61H 1/00

[52] U.S. Cl. ..... 128/41; 128/33

[58] Field of Search ..... 128/41, 33, 32, 24 R

[56] References Cited

U.S. PATENT DOCUMENTS

| | | | |
|---|---|---|---|
| 1,529,872 | 3/1925 | Craig | 128/33 |
| 1,615,615 | 1/1927 | Cannon et al. | 128/33 |
| 2,096,646 | 10/1937 | Thornton-Norris | 128/41 |
| 2,587,207 | 2/1952 | Peterson | 128/33 |
| 2,681,650 | 6/1954 | Goss | 128/33 |
| 3,068,858 | 12/1962 | Suarez | 128/41 |
| 3,113,567 | 12/1963 | Russell | 128/33 |
| 3,830,232 | 8/1974 | McNair | 128/41 |
| 3,835,844 | 9/1974 | Lang | 128/33 |
| 3,981,032 | 9/1976 | Brooks | 128/33 |
| 4,175,550 | 11/1976 | Leininger et al. | 128/24 R |
| 4,326,506 | 4/1982 | Kawabata | 128/41 |
| 4,370,602 | 1/1983 | Jones, Jr. et al. | 128/41 |

FOREIGN PATENT DOCUMENTS

| | | | |
|---|---|---|---|
| 328408 | 5/1930 | United Kingdom | 128/41 |

*Primary Examiner*—Edgar S. Burr
*Assistant Examiner*—Tonya Lamb
*Attorney, Agent, or Firm*—Max Geldin

[57] ABSTRACT

A back massager device which comprises a back support, a footrest connected adjacent to one end of the back support and a headrest connected to the opposite end of the back support. The back support is positioned on resilient padding placed on a support table. The back support is preferably in the form of a pair of spaced longitudinally extending bars inserted in a cushioning material. A first series of vibrators is connected to one of the support bars and a second series of vibrators is connected to the other support bar. In the preferred embodiment, the vibrators each comprise an electrical coil, a magnet associated with the coil for actuation thereby, the magnet being mounted on a vibratable arm, and a member connecting the arm and a support bar for vibration thereof in response to actuation of the magnet by the coil. Structure in the form of an adjustable screw is provided on the vibratable arm for varying the amount of vibration transmitted to the support bar. Structure is provided for adjusting the longitudinal position of the footrest and also for adjusting the angle of the foot support provided on the footrest. Structure is also provided for pivoting the headrest at an angle with respect to the back support.

13 Claims, 3 Drawing Sheets

FIG. 1
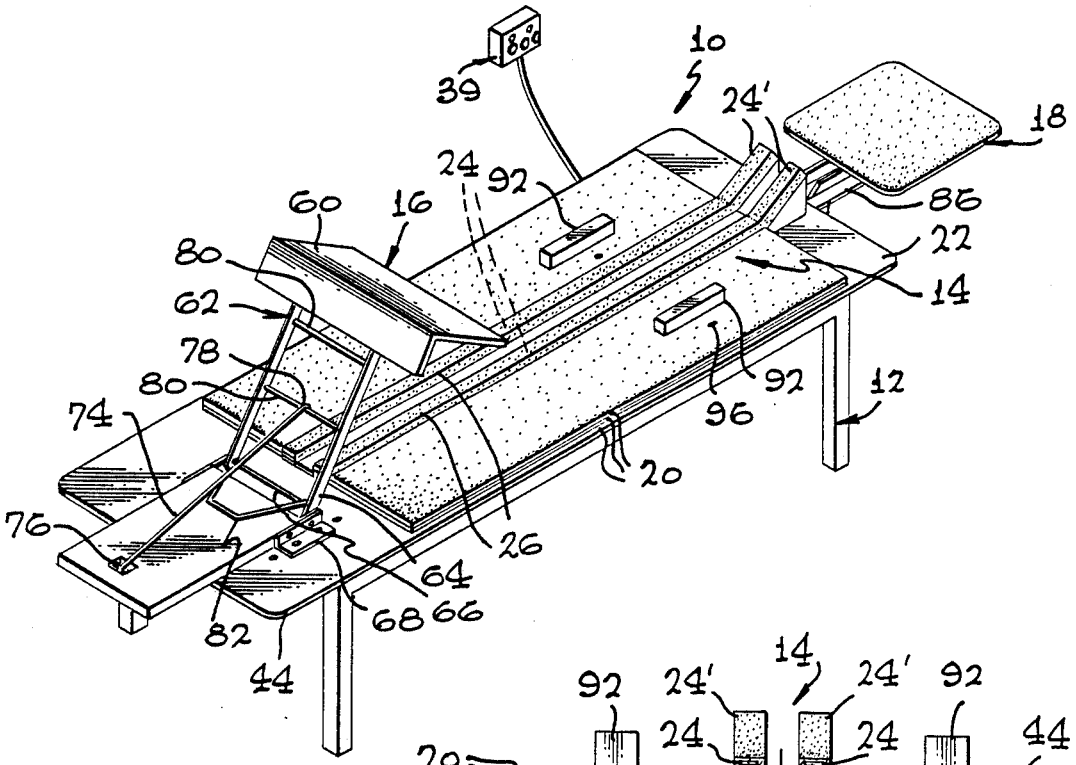
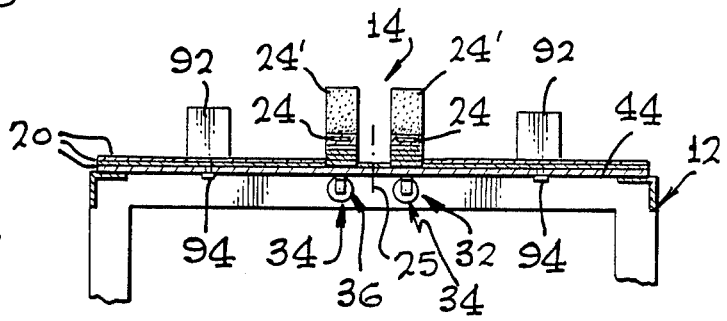
FIG. 5
FIG. 2A
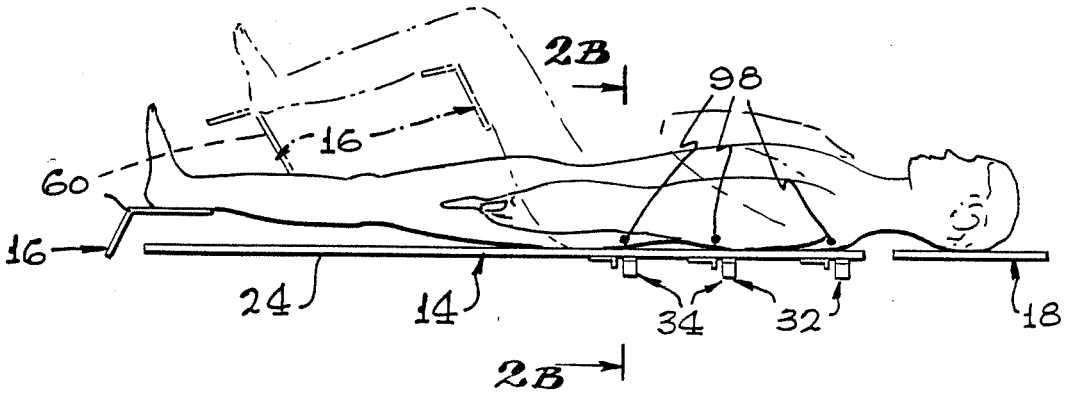

FIG. 2B
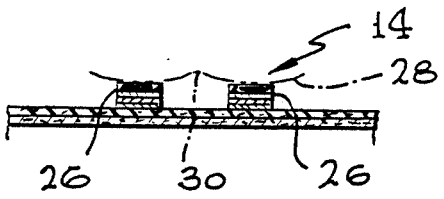
FIG. 2C
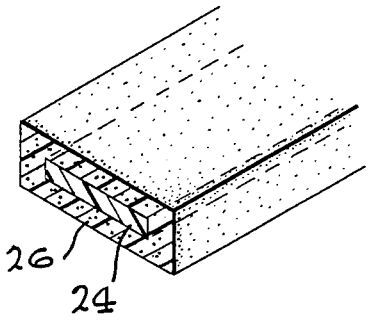
FIG. 6
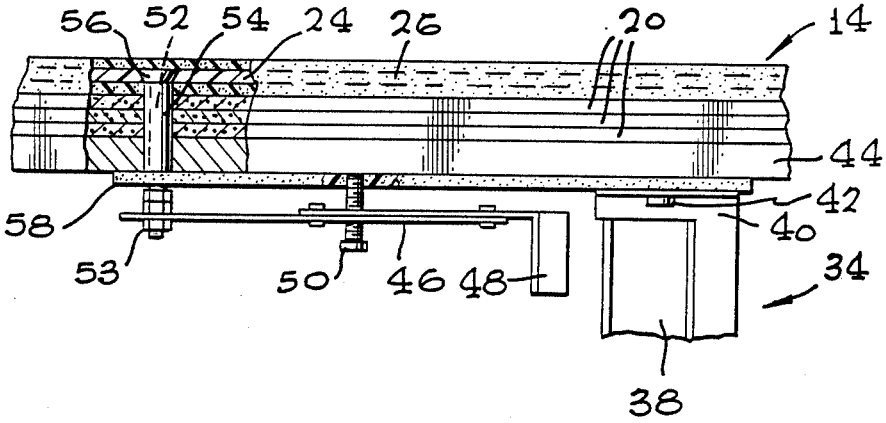
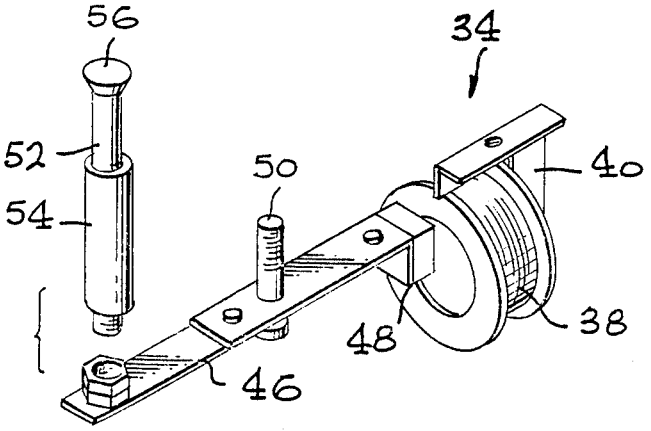
FIG. 7

BACK MASSAGER WITH TWO SUPPORT BARS FOR BACK

BACKGROUND OF THE INVENTION

This invention relates to a back massager device and is particularly concerned with a device for massaging or hygienically treating a person's back, especially along or adjacent the backbone or spinal column.

It is an object of the present invention to provide an efficient back massager for treating and toning the back, especially along the backbone.

Another object is the provision of a back massager having vibration means positioned for effectively massaging the back along preselected portions or areas thereof, such as the backbone.

Still another object of the invention is to provide a back massager device of relatively simple but sturdy structure and which is versatile in effecting improved hygienic treatment of the back, as well as other related parts of the body, such as the shoulders, arms and legs.

SUMMARY OF THE INVENTION

The above and other objects of the invention are achieved by providing a back massager comprising a back support, a footrest connected adjacent one end of the back support, and a headrest connected adjacent the opposite end of the back support.

A first series of vibrators is positioned and spaced longitudinally along the back support on one side of the longitudinal central axis thereof, and a second series of vibrators is similarly positioned and spaced longitudinally along the back support on the other side of the longitudinal central axis thereof. Thus, the two series of vibrators can be positioned to massage the back along the backbone or spinal column closely adjacent thereto and on opposite sides thereof.

More specifically, the back support comprises a pair of laterally spaced longitudinally extending support bars positioned on opposite sides of the longitudinal axis of the back support, which can be made of plastic and encased in a cushioning material. The first series of vibrators is connected to one of such support bars, and the second series of vibrators is connected to the other of such support bars. In a preferred embodiment, each of the vibrators comprises an electric coil, a vibrator arm having a magnet mounted at one end thereof, and a pin mounted on its opposite end in operative engagement with one of the support bars, for vibration of the support bars in response to actuation of the coil and magnet. Means in the form of an adjustable screw is provided on the vibratable arm for varying the amount of vibration transmitted to the support bars by the pin. The vibrators can be arranged for selective actuation. An insulating member can also be provided between the vibrators and the back support for reducing noise from the vibrators.

The footrest comprises a foot support member, and means is provided for longitudinally adjusting the position of the footrest, and means is also provided for adjusting the angle of the foot support with respect to the back support. The headrest comprises a hinge plate and means is provided for pivoting the hinged headrest at a desired angle with respect to the back support.

There is thus provided an improved yet simple, sturdy and versatile back massager according to the invention, which has a number of important functions and advantages. Thus, the back massager hereof can reduce back pains and stress and can aid in reducing disk slippage and also in reducing backbone rigidity. The vibratory action of the machine also aids in blood circulation. Pains in the shoulders, arms, hands, and legs can also be reduced by the action of the vibratory back massager of the invention. In addition, side pains or stomach pains can also be alleviated by the vibratory action of the back massager hereof.

BRIEF DESCRIPTION OF THE DRAWINGS

The invention will be more readily understood from the description below of a preferred embodiment, taken in conjunction with the accompanying drawings, wherein:

FIG. 1 is a perspective view of a back massager device according to the invention, showing the footrest and headrest in one position;

FIG. 2A is a diagrammatic side view of a portion of the device of FIG. 1, showing a person in position on the back support, and with the footrest in different positions;

FIG. 2B is a view taken on line 2B—2B of FIG. 2A, showing the vibratable back support bars positioned longitudinally along the backbone area;

FIG. 2C is a partial perspective view of a back support bar inserted in a cushioning material;

FIG. 5 is a section taken on line 5—5 of FIG. 3;

FIG. 6 is an enlarged partial side view of the device of FIG. 1, partly broken away and showing in detail the vibrator mechanisms; and FIG. 7 is a perspective view of the vibrator mechanism.

DESCRIPTION OF A PREFERRED EMBODIMENT

Figure 3:
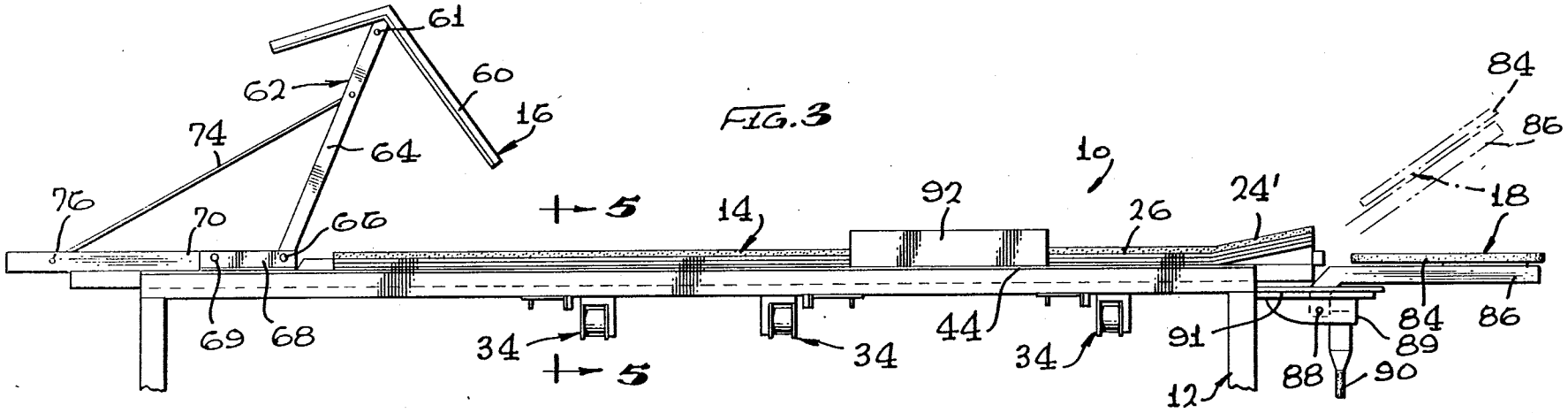
FIG. 3 is a side elevation of the device of FIG. 1, partly broken away.

Referring to FIGS. 1, 3, 4 and 5 of the drawings, numeral 10 is a back massager device of the invention, mounted on a table 12, and comprising a back support, indicated at 14, a footrest 16, and a headrest 18.

The back support 14 rests on resilient padding in the form of a plurality, here shown as three in number, of cushioning sheets or carpets 20 (see also FIG. 6) laid flat on the top surface 22 of the table. The back support 14 is composed of a pair of laterally spaced longitudinally extending parallel support bars 24 positioned on opposite sides of the longitudinal central axis 25 of the back support. The support bars 24 can be made of plastic. The support bars are inserted or encased in a cushioning material 26 (see also FIGS. 2B and 2C), such as polyurethane foam. It is seen that the back 28 of a person is supported centrally on the cushioned support bars 24, on opposite sides of and closely adjacent to, that is, in the area of, the backbone 30. The cushioned support bars 24 at the upper end of the back support 14 can be angled upwardly, as indicated at 24', if desired, to accommodate a person's neck.

Figure 4:
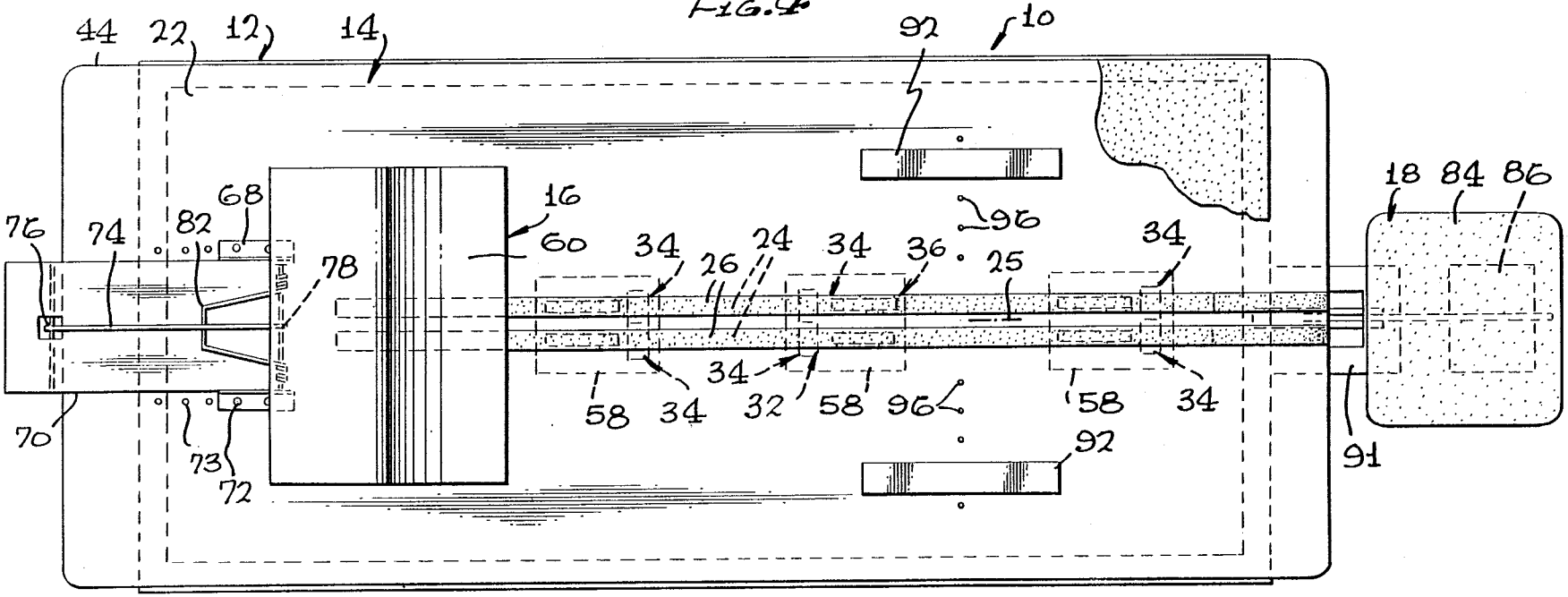
FIG. 4 is a top plan view of the device of FIG. 1.

A first series 32 of three vibrators or vibrator mechanisms 34 is positioned and spaced longitudinally along and below one of the support bars 24, and a second series 36 of three like vibrators 34 is similarly positioned and spaced longitudinally along and below the other support bar 24, the respective vibrators 34 in each of the two series of vibrators 32 and 36 being positioned opposite each other laterally, as best seen in FIG. 4. The middle vibrator 34 of the vibrators in each of the two series 32 and 36 is preferably positioned approximately centrally between the first and last vibrators of such series, or it can be placed closer to one of the end vibrators than the other.

Viewing FIGS. 6 and 7, the vibrator mechanisms 34 are all of the same structure, each comprising an electric coil 38 actuated by an A.C. power supply (not shown) from a control station 39 and mounted on a bracket 40 connected by screws 42 to the top or base plate 44 of table 12. A vibrator arm 46 in the form of a flexible link is provided with a magnet 48 mounted at one end adjacent the coil 38, for actuation when the coil is energized.

A screw 50 is provided at about the midpoint of the arm 46, the inner end of the screw just touching the base plate 44. An elongated screw or pin 52 is connected by fasteners 53 to the opposite end of vibrator arm 46, and passes through a sleeve 54. The inner end of screw 52 is connected by means of a nut 56 to one of the support bars 24. Vibration of the magnet 48 when the coil 38 is energized produces a vibration of the flexible linkage arm 46 which is transmitted via the screw 52 to the support bar 24. An insulator, e.g., rubber, pad 58 is attached to the lower surface of plate 44 above the vibrator mechanism 34 to reduce the noise from the vibrator. The screw 50 passes through rubber pad 58 and can be adjusted to change the distance of the magnet 48 from the rubber pad, which in turn varies the amount of vibration transmitted by screw 52 to the associated foam-covered support bar 24. Thus, the lower the position of magnet 48 from the rubber pad 58, the less the amount of vibration transmitted to the associated cushioned support bar 24.

The footrest 16 comprises an angled foot support member or plate 60 pivotally connected at 61 to the upper end of a frame 62 having opposite side members 64, the lower ends of which are pivotably mounted on a pivot rod 66 connected to a pair of brackets 68 in turn connected at 69 (see FIG. 3) to opposite sides of a plate 70 resting on the top surface 22 of the table. The brackets 68 are connected by fasteners 72 to the table top 44. The plate 70, together with the foot support plate 60, is movable longitudinally with respect to the back support bars 24 by adjusting the fasteners 72 in the respective longitudinally extending holes 73 (see FIG. 4) provided in table top 44.

A link 74 is pivotally mounted at 76 adjacent the front end of the plate 70 and has a hook 78 for selective attachment to one or the other of rods 80 attached to opposite side members 64 of frame 62, to vary the anole of the foot support plate 60, as illustrated in FIG. 2A. A spring 82 is mounted on pivot rod 66 and in contact with the upper surface of movable plate 70, and tends to bias or balance the foot support plate 60 in a counterclockwise direction against the force of the feet on the plate, tending to rotate the plate in a clockwise direction.

The headrest 18 comprises a plate 84 mounted on a support member 86, which is hinged at 88 on a bracket 89 connected to an extension 91 of the table top 44, for adjustment of plate 84 to a desired angular position, as shown in dotted lines in FIG. 3. A handle 90 is provided to actuate the headrest for such angular adjustment.

A pair of side blocks 92 are positioned on the upper surface of the carpeting 20 on opposite sides of the vibratable support bars 24, and are connected by screws 94 (see FIG. 5) to the top 44 of table 12. The blocks 92 extend longitudinally parallel to the support bars 24 and function to center the back on the support bars. A plurality of transversely positioned holes 96 are provided through the carpeting 20 and table top 44 to permit adjustment by screws 94 of the space between the blocks 92 for persons whose backs are different in width.

In operation, a person using the back massager hereof first adjusts the longitudinal position of the footrest 16 and the desired angle of the foot support 60, as described above, to the desired angular position, e.g., as illustrated in FIG. 2A, and then adjusts the desired position of the headrest 18, e.g., either flat, as seen in FIG. 2A, or at any desired angle, as illustrated in dotted lines in FIG. 3, as also described above. The proper transverse position of the blocks 92 is also achieved. The person then lies down with his back in contact with, and positioned centrally on, the vibrator support bars 24 and with the backs of the feet in contact with the footrest 16 and the head resting on the headrest 18, as illustrated in FIG. 2A.

The A.C. power supply for the vibrators 24 is then turned on at the control station 39, causing the vibrators 34 to function and transmit vibrations to the support bars 24 substantially uniformly along the length thereof for massaging the back in contact with the support bars, along the length of the back, and particularly at the contact points 98 of the back with the support bars 24 directly above the vibrators, for each of the support bars, as seen in FIG. 2A. It will be noted that such massaging occurs along the length of the back and on both sides thereof closely adjacent the backbone 30, as seen in FIG. 2B.

It will be understood that various changes can be made in the invention device by those skilled in the art. Thus, although use of two longitudinally extending spaced vibrator support bars 24 is preferred, if desired a plurality of more than two vibrator support bars can be employed and arranged for vibration in the manner described above. Further, the number of vibrators for vibrating each support bar 24 can be varied. Also, if desired, the system can be arranged so that the vibrators for each support bar can be selectively and independently actuated and/or so that only certain of the vibrators are actuated for each support bar, e.g., to effect massaging of only certain localized areas of the back. Further, vibrators of a design and construction different from the vibrators 34 shown and described above can be employed.

From the foregoing, it is seen that there is provided, according to the invention, an efficient device for massaging the back which is relatively simple in construction and operation.

Various further changes and modifications can be made in the invention without departing from the spirit of the invention. Hence, the invention is not to be taken as limited except by the scope of the appended claims.

What is claimed is:

1. A back massager device which comprises:

a back support having a longitudinal central axis and comprising a pair of laterally spaced longitudinally extending parallel support bars positioned on opposite sides of said central longitudinal axis, a footrest connected adjacent to one end of said back support, a headrest connected adjacent to the opposite end of said back support, a first series of vibrators positioned and spaced longitudinally along said back support on one side of the longitudinal central axis thereof, means connecting said first series of vibrators to one of said support bars, a second series of vibrators positioned and spaced longitudinally along said back support on the other side of the longitudinal central axis thereof, means connecting said second series of vibrators to the other of said support bars, and means for actuating said first series of vibrators and said second series of vibrators.

2. The device of claim 1, said first series of vibrators and said second series of vibrators being approximately equally spaced laterally on opposite sides of said central longitudinal axis.

3. The device of claim 1, said vibrators each comprising an electric coil, a magnet associated with said coil for actuation thereby, a vibratable arm, means mounting said magnet on said arm, said connecting means including a connecting member connecting said arm and one of said support bars for vibration of said support bar in response to actuation of said magnet by said coil.

4. The device of claim 1, said vibrators each comprising an electric coil, a magnet associated with said coil for actuation thereby, a vibratable arm, means mounting said magnet on said arm, said connecting means including a pin mounted on said arm and in operative engagement with one of said support bars for vibration thereof in response to actuation of said magnet by said coil, and means mounted on said arm for changing the amount of vibration transmitted by said pin to said one of said support bars.

5. The device of claim 1, including means for longitudinally adjusting the position of said footrest, said footrest comprising a foot support and means for adjusting the angle of said foot support with respect to said back support.

6. The device of claim 1, including means for pivoting the headrest at an angle with respect to the back support.

7. The device of claim 1, including movable longitudinally extending blocks on opposite sides of said longitudinally extending support bars for centrally positioning the back on said support bars.

8. A back massager device which comprises:

a back support having a longitudinal central axis and comprising a pair of laterally spaced longitudinally extending parallel support bars positioned on opposite sides of said central longitudinal axis, a footrest connected adjacent to one end of said back support, a headrest connected adjacent to the opposite end of said back support, a first series of vibrators positioned and spaced longitudinally along said back support on one side of the longitudinal central axis thereof, means connecting said first series of vibrators to one of said support bars, a second series of vibrators positioned and spaced longitudinally along said back support on the other side of the longitudinal central axis thereof, means connecting said second series of vibrators to the other of said support bars, means for actuating said first series of vibrators and said second series of vibrators, and cushioning material covering each of said support bars.

9. The device of claim 8, said support bars each comprised of plastic and forming an insert within said cushioning material.

10. A back massager device which comprises, a table, resilient padding on said table, a back support on said resilient padding, said back support having a central longitudinal axis and comprising a pair of laterally spaced longitudinally extending parallel support bars positioned equidistantly on opposite sides of said central longitudinal axis, cushioning material covering said support bars, a first series of vibrators positioned and spaced longitudinally along and below one of said support bars, a second series of vibrators positioned and spaced longitudinally along and below the other support bar, said vibrators positioned below said table, each vibrator comprising an electric coil, a magnet associated with said coil for actuation thereby, a vibratable arm, said magnet mounted on one end of said arm and a pin mounted on the other end of said arm and connected to one of said support bars for vibration thereof in response to actuation of said magnet by said coil, a footrest on said table adjacent one end of said back support, and a headrest on said table adjacent the other end of said back support.

11. The device of claim 10, including an insulating member associated with said vibrators for reducing noise from said vibrators, said insulating member connected to the lower surface of said table.

12. The device of claim 11, including an adjustable screw mounted on said vibratable arm intermediate the ends thereof, for changing the amount of vibration transmitted by said pin to said one of said support bars.

13. The device of claim 12, including means for longitudinally adjusting the position of said footrest, said footrest comprising a spring biased foot support and means for adjusting the angle of said foot support with respect to said back support, means for pivoting the headrest at an angle with respect to the back support, and movable longitudinally extending blocks on opposite sides of said longitudinally extending support bars for centrally positioning the back on said support bars.

* * * * *